US010413090B2

(12) United States Patent
Hardy

(10) Patent No.: US 10,413,090 B2
(45) Date of Patent: Sep. 17, 2019

(54) PRODUCT MANAGEMENT DISPLAY SYSTEM

(71) Applicant: RTC Industries, Inc., Rolling Meadows, IL (US)

(72) Inventor: Stephen N. Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 15/774,865

(22) PCT Filed: Sep. 21, 2016

(86) PCT No.: PCT/US2016/052851
§ 371 (c)(1),
(2) Date: May 9, 2018

(87) PCT Pub. No.: WO2017/116518
PCT Pub. Date: Jul. 6, 2017

(65) Prior Publication Data

US 2018/0325285 A1 Nov. 15, 2018

Related U.S. Application Data

(60) Provisional application No. 62/273,551, filed on Dec. 31, 2015.

(51) Int. Cl.
*A47F 3/14* (2006.01)
*A47B 65/00* (2006.01)
(Continued)

(52) U.S. Cl.
CPC ..... *A47F 3/14* (2013.01); *A47B 57/58* (2013.01); *A47B 65/10* (2014.12); *A47B 65/15* (2014.12);
(Continued)

(58) Field of Classification Search
CPC ..... A47F 3/14; A47F 5/0025; A47F 5/005; A47F 1/125; A47F 5/132; A47F 7/144;
(Continued)

(56) References Cited

U.S. PATENT DOCUMENTS 2,140,656 A * 12/1938 Smith ..... A47B 65/20 211/43
3,698,568 A * 10/1972 Armstrong ..... A47F 5/005 211/184
(Continued)

FOREIGN PATENT DOCUMENTS

WO 2015/112834 A1 7/2015

OTHER PUBLICATIONS

International Search Report and Written Opinion for PCT/US2016/052851 (dated Nov. 14, 2016).

*Primary Examiner* — Jennifer E. Novosad
(74) *Attorney, Agent, or Firm* — Banner & Witcoff, Ltd.

(57) ABSTRACT

An adjustable tray for a merchandise display system may include a retainer for limiting the movement of products loaded in the adjustable tray, a first divider extending from a first panel and second divider extending from a second panel. The spacing between the first divider and the second divider can be configured to be adjusted. The first panel and the second panel can be configured to move to provide additional surface area for the adjustable tray to accommodate different sized products. The adjustable tray may further include a pusher mechanism configured to bias product toward the retainer.

16 Claims, 8 Drawing Sheets

(51) Int. Cl.
*A47F 5/00* (2006.01)
*A47B 57/58* (2006.01)
*A47F 1/12* (2006.01)

(52) U.S. Cl.
CPC ..... *A47F 5/005* (2013.01); *A47F 5/0025* (2013.01); *A47F 1/125* (2013.01)

(58) Field of Classification Search
CPC ..... A47F 5/10; A47B 57/58; A47B 65/00; A47B 57/583; A47B 57/588; A47B 57/585; A47B 65/10; A47B 65/15; A47B 96/04; A47B 45/00; A47B 96/025
USPC ..... 211/184, 175, 59.3, 43; 108/60, 61; 312/71, 72, 42, 45
See application file for complete search history.

(56) References Cited

U.S. PATENT DOCUMENTS 3,703,964 A * 11/1972 Field ..... A47F 5/005 211/184
3,844,415 A * 10/1974 Heimann ..... A47B 65/00 211/43
3,877,580 A * 4/1975 Hammar ..... A47B 57/581 108/27
4,135,626 A * 1/1979 Cawood ..... A47B 65/00 211/43
4,856,658 A * 8/1989 Novak ..... F16M 13/00 211/26.1
4,874,099 A * 10/1989 Arnott ..... A47G 21/16 211/50
5,035,332 A * 7/1991 Stravitz ..... A47B 47/00 211/184
5,366,099 A * 11/1994 Schmid ..... A47F 1/126 211/175
5,458,248 A * 10/1995 Alain ..... A47B 45/00 211/153
5,474,190 A * 12/1995 Won-Kim ..... A47B 57/588 211/184
5,855,283 A * 1/1999 Johnson ..... A47F 1/126 211/103
6,227,513 B1 * 5/2001 Richard ..... A47G 7/025 211/43
6,352,162 B1 * 3/2002 Yang ..... A47B 65/00 211/43
6,357,606 B1 * 3/2002 Henry ..... A47F 1/126 211/184
6,823,997 B2 * 11/2004 Linden ..... A47F 5/005 211/175
7,458,473 B1 * 12/2008 Mason ..... A47F 1/126 211/175
7,703,614 B2 * 4/2010 Schneider ..... A47F 3/14 211/184
8,047,385 B2 * 11/2011 Hardy ..... A47F 1/12 211/59.3
8,066,128 B2 * 11/2011 Crawbuck ..... A47F 1/125 211/59.2
8,556,092 B2 * 10/2013 Valiulis ..... A47F 5/005 108/61
8,967,394 B2 * 3/2015 Hardy ..... A47F 1/126 211/59.3
9,138,076 B2 * 9/2015 Hardy ..... A47F 1/126
9,445,675 B1 * 9/2016 DeSena ..... A47F 1/126
9,901,191 B1 * 2/2018 Schmidt ..... A47F 1/125
9,986,852 B2 * 6/2018 Chenoweth ..... F21V 21/08
10,034,557 B1 * 7/2018 Nagel ..... A47B 57/58
10,154,739 B2 * 12/2018 Turner ..... A47F 1/125
2003/0217980 A1 * 11/2003 Johnson ..... A47F 1/126 211/59.3
2004/0079715 A1 * 4/2004 Richter ..... A47F 1/126 211/59.3
2007/0170127 A1 * 7/2007 Johnson ..... A47F 1/126 211/59.3
2010/0072154 A1 * 3/2010 Johnson ..... B60R 7/02 211/184
2011/0284571 A1 * 11/2011 Lockwood ..... A47F 1/126 221/151
2012/0205334 A1 * 8/2012 Liu ..... A47B 45/00 211/162
2018/0325285 A1 * 11/2018 Hardy ..... A47F 3/14

* cited by examiner

PRODUCT MANAGEMENT DISPLAY SYSTEM

The application is a U.S. National Phase entry of International Application No. PCT/US2016/052851 filed on Sep. 21, 2016, designating the United States of America and claiming priority to U.S. Application No. 62/273,551 filed Dec. 31, 2015. The present application claims priority to and the benefit of the above-identified applications and the above-identified applications are incorporated by reference herein in their entirety for all purposes.

FIELD

The exemplary embodiments herein relate generally to a shelf assembly for use in merchandising product and more particularly to an adjustable shelf assembly for displaying and advancing product on shelves.

BACKGROUND

Retail and wholesale stores, such as convenience stores, drug stores, grocery stores, discount stores, and the like, require a large amount of shelving both to store product and to display the product to consumers. In displaying product, it may be desirable for the product on the shelves to be situated toward the front of the shelf so that the product is visible and more accessible to consumers. In the case of coolers or refrigerators that are used to store and display such products as soft drinks, energy drinks, bottled water, and other bottled or canned beverages, it may be desirable for these products to also be situated toward the front of the shelf and visible and accessible to the consumers.

To accomplish this placement of product, systems may include inclined trays or floors that through gravity will cause the product to move toward the front of the shelf. Many of these systems include floors or shelves made of a plastic material such as polypropylene that due its low coefficient of friction permit the product to easily slide along the inclined floor or surface. Other systems may include the use of a pusher system to push the product toward the front of the shelf as the product at the front of the shelf is removed. Pusher systems may be mounted to a track and may include a pusher paddle and a coiled spring to urge the product forward.

SUMMARY

In one example, a merchandise display system may include one or more of: a retainer for limiting the movement of products loaded in a tray, a first divider extending from a first panel and a second divider extending from a second panel such that the spacing between the first divider and the second divider is configured to be adjusted to accommodate for different sized products.

BRIEF DESCRIPTION OF THE DRAWINGS

A more complete understanding of the present disclosure and certain advantages thereof may be acquired by referring to the following detailed description in consideration with the accompanying drawings, in which.

Figure 1:
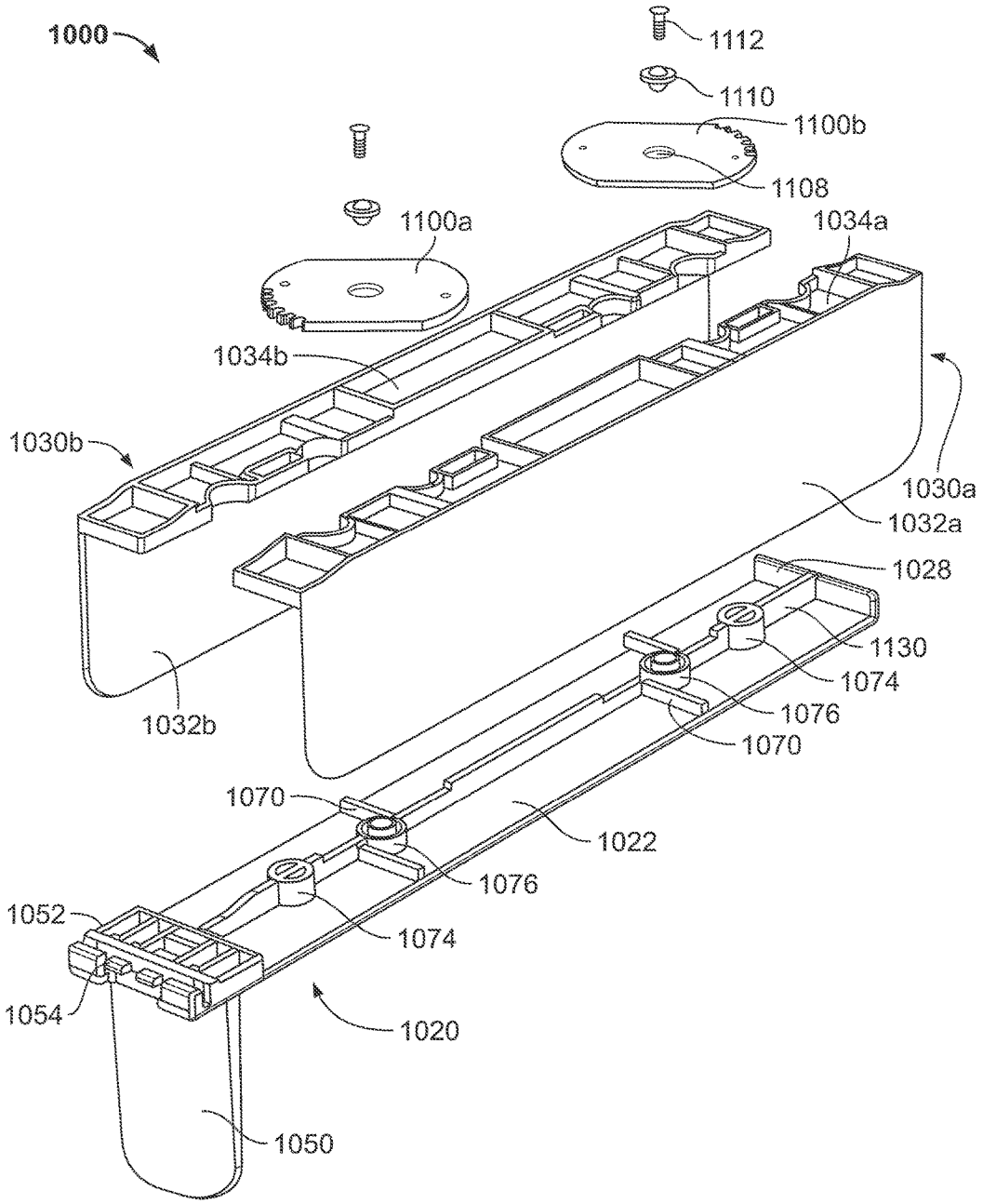
FIG. 1 depicts a bottom perspective view of an example product management display system for merchandising product on an adjustable tray in an exploded configuration.

Before the examples are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, the use of the term "mount," "mounted" or "mounting" is meant to broadly include any technique or method of mounting, attaching, joining or coupling one part to another, whether directly or indirectly.

DETAILED DESCRIPTION

FIG. 1 depicts an example of components of an adjustable tray 1000 of a product management display system for merchandising product on a shelf. In particular, the components of the adjustable tray may be provided separately and can be configured to be easily assembled. The components may also provide for easy storage before assembly. After assembly, the adjustable tray may also be easily stored, retrieved, and adjusted as necessary for use. The adjustable tray provides adjustable lane sizes for holding and dispensing products of different sizes. Hence storage of a variety of different sized trays may not be required.

Figure 4:
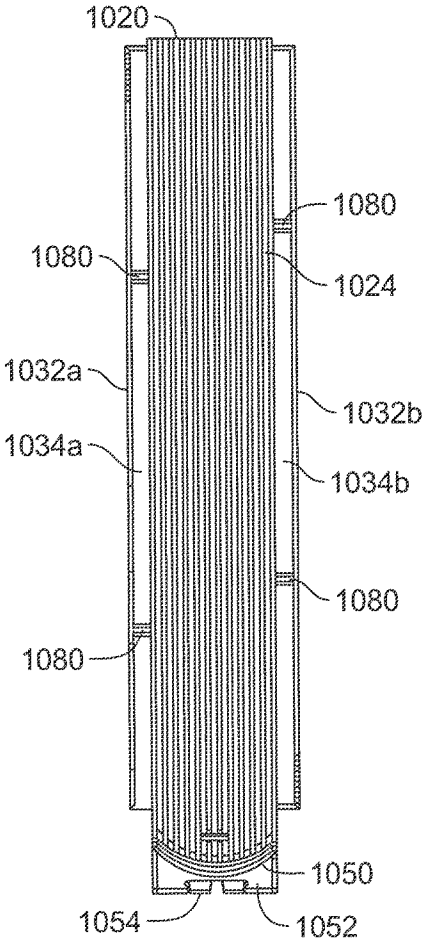
FIG. 4 shows a top view of the product management display system of FIG. 1.
Figure 6:
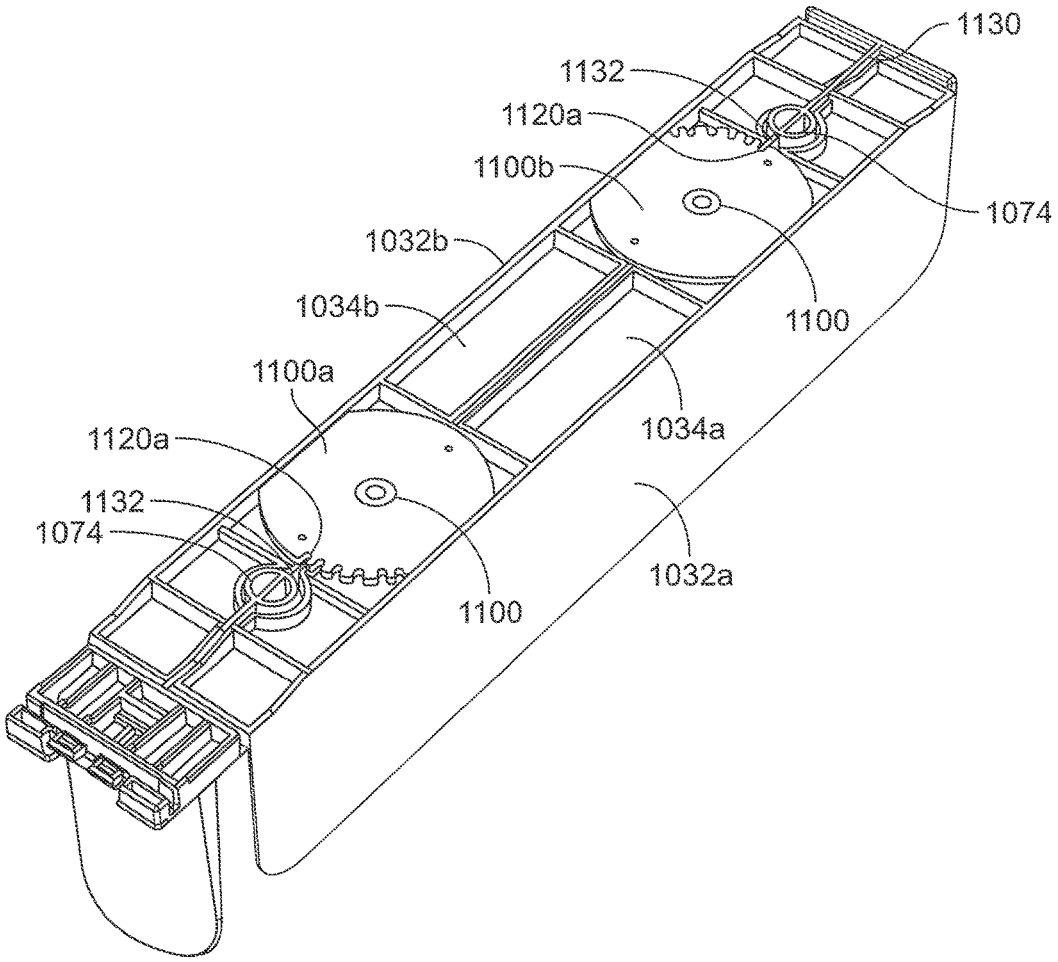
FIG. 6 shows a bottom perspective front view of the product management display system of FIG. 1 with the walls in a non-extended position.

FIG. 1 shows a bottom perspective view of the components of the adjustable tray 1000 in an exploded configuration. In one example, the adjustable tray 1000 can include five separate components, a floor 1020, two adjustable dividers 1030*a*, 1030*b*, and two cams 1100*a*, 1100*b*. As shown in FIGS. 4 and 6, for example, the tray 1000, the adjustable dividers 1030*a*, 1030*b*, and the cams 1100*a*, 1100*b* can be assembled into an integral assembly to form the adjustable tray 1000. In one example, the five components can be made from three molds whereby the adjustable dividers 1030*a*, 1030*b*, are formed identical, and the cams 1100*a*, 1100*b* are formed identical.

The two adjustable dividers 1030*a* and 1030*b* may be identical parts, having vertical walls 1032*a* and 1032*b* and horizontal panels 1034*a* and 1034*b*, respectively. Panel 1034*a* extends perpendicularly from wall 1032*a* and panel 1034*b* extends perpendicularly from wall 1032*b*. Cams 1100*a* and 1100*b* are configured to connect the adjustable dividers 1030*a* and 1030*b* to the floor 1020 and lock the adjustable dividers 1030*a* and 1030*b* in position relative to one another. The cams 1100*a* and 1100*b* also operate as dials with various settings to provide the adjustable tray 1000 with different widths to accommodate differently sized products.

Specifically, the adjustable dividers 1030*a* and 1030*b* and cams 1100*a* and 1100*b* are configured to adjust the width of the adjustable tray 1000 to accommodate different sized products therein. In particular, divider 1030*a* and divider 1030*b* can both be moved laterally or horizontally with respect to floor 1020 such that the spacing between the wall 1030*a* and the wall 1030*b* is adjusted to accommodate various dimensioned products.

Figure 2:
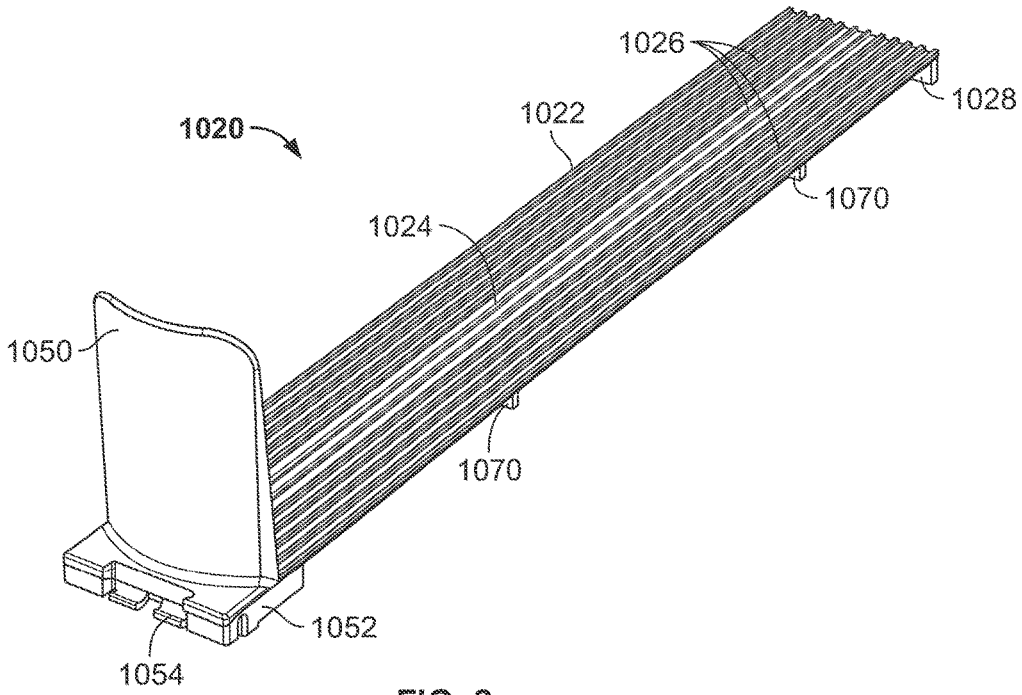
FIG. 2 shows a front perspective view of the floor of the product management display system of FIG. 1.

FIGS. 1 and 2 depicts floor 1020. In this example, the floor 1020 may generally include a bottom panel 1022 and a retainer 1050. As discussed herein, the floor 1020, including bottom panel 1022, retainer 1050, and front portion 1052, may be formed as a single molded piece. The floor 1020 can be formed of a predetermined width to accommodate a variety of product size widths. In certain instances the floor is configured to support a central region of the product. Floor 1020 has a bottom panel 1022 which has an upper surface 1024. The upper surface 1024 may contain multiple raised ribs 1026 extending along the upper surface 1024 from the back to the front of the bottom panel. The ribs 1026 form a reduced frictional contact surface to allow the product to slide more easily along the panel. A flange 1028 is formed at a back end of bottom panel 1022 and extends vertically downward. The flange 1028 provides a mounting structure for the support 1130. Also in certain instances, when attached to a shelf, for example, the flange 1028 may be configured to engage a surface of the shelf to prevent the adjustable tray from moving forward.

Optionally, guide rails 1070 may extend vertically downward from bottom panel 1022. The guide rails 1070 can be placed in corresponding channels 1080 (FIG. 3) in panels 1034*a* and 1034*b* as the width between the walls is adjusted in order to allow only lateral movement (avoiding skewing) between the panels and the floor. Additionally the guide rails 1070 can be formed offset to one another to provide a longer guiding surface to the support 1130 of the floor 1020. Alternatively, containment of the two dividers 1030*a* and 1030*b* front to back could occur only at the far ends of the floor 1020. Further, the two cams, once engaged, could hold everything together in a parallel arrangement.

As shown in FIG. 1, the floor 1020 may also include a support 1130, which extends from the bottom panel 1022. The support 1130 provides for a mounting location for a button 1074, which when depressed allows for the dividers 1030*a* and 1030*b* to adjust relative to one another and the floor 1020. The button 1074 is provided with a degree of flexibility such that the user can move the button 1074 axially inward and the button 1074 returns to its original position when the button 1074 is released. The button 1074 includes a finger or portion 1132 for engaging the notches 1120 of the cams 1110*a*, 1110*b*. Specifically, as will be discussed in further detail below, when the user engages each button 1074 the corresponding fingers or portions 1132 are moved out of contact with the cams 1100*a*, 1100*b* and the dividers 1030*a* and 1030*b* can be adjusted relative to one another.

A retainer 1050 extends vertically upwardly from an end of bottom panel 1022 to form the front of the adjustable tray 1000. The retainer 1050 can be provided for limiting the movement of products loaded in the adjustable tray 1000 or the forward progression of the products loaded in the adjustable tray 1000 by a pusher mechanism. Retainer 1050 may have a curved surface to accommodate cylindrical products such as bottles and cans. The curvature of the curved surface can be selected such that it accommodates large diameter products as well as small diameter products. The curvature of the retainer 1050 also provides for additional strength and rigidity to the retainer 1050 for maintaining products on the shelf. The retainer 1050 can also be provided with a number of fillets adjoining the retainer 1050 to the floor 1020. The fillets provide for additional strength and rigidity to the retainer 1050 for maintaining products on the shelf.

In one example, a front portion 1052 of the adjustable tray 1000 can include a locking mechanism 1054 for securing the adjustable tray 1000 relative to a front rail (not shown), which can be mounted to a shelf. When in the unlocked position, the adjustable tray 1000 can be configured to slidingly engage the front rail so as to allow adjustment of the adjustable tray 1000 along the front rail. This allows adjustment of the adjustable tray along the shelf. Additionally, the adjustable tray 1000 can be configured to lock to the front rail. Any suitable locking mechanism is contemplated. For example, U.S. application Ser. No. 14/245,779, filed on Apr. 4, 2014, now U.S. Pat. No. 9,173,504, includes such exemplary rail locking system and is fully incorporated herein by reference.

A pusher may be utilized to push products along the upper surface 1024. Any suitable pusher mechanism is contemplated, which can include a coil spring for advancing products toward the front of the shelf. For example, U.S. Pat. No. 9,173,504 includes such exemplary pusher systems. In one example, a heavy duty coiled spring can be used such that the adjustable tray 1000 can be used with any number of different sized products. However, it is also contemplated that the pusher and coil spring can be easily adjusted or replaced for accommodating different sized products. Additionally, the adjustable tray could be integrated as part of a gravity fed system without the use of a pusher.

The product (not shown) can rest on the upper surface 1024 and in particular the multiple raised ribs 1026 of the bottom panel 1022 of floor 1020, and can be biased toward the retainer 1050 by a pusher mechanism using a coiled spring (not shown) in a similar manner to the examples shown and described in U.S. Pat. No. 9,173,504.

Figure 3:
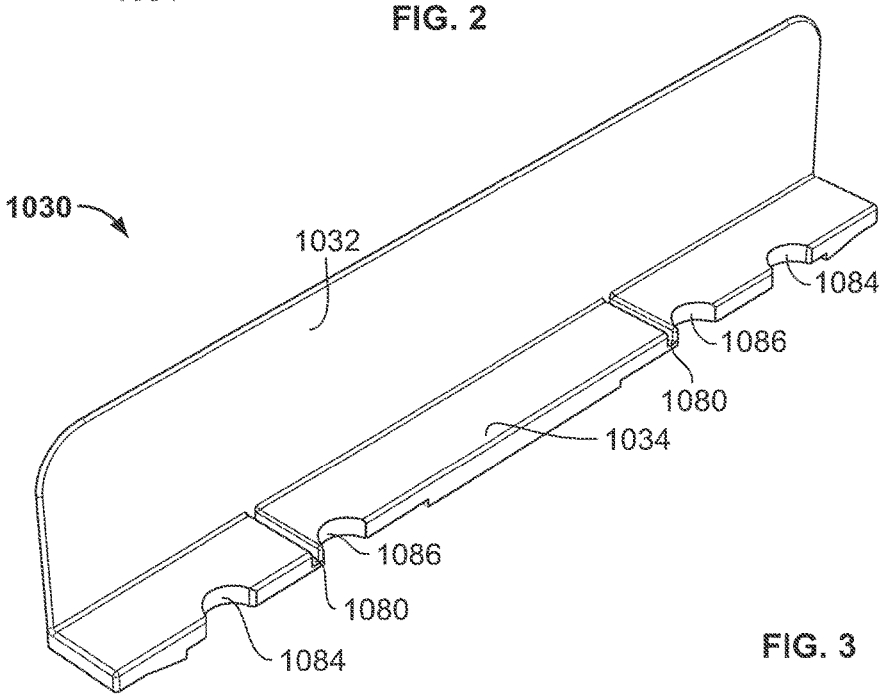
FIG. 3 shows an inside perspective view of an adjustable divider of the product management display system of FIG. 1.
Figure 11A:
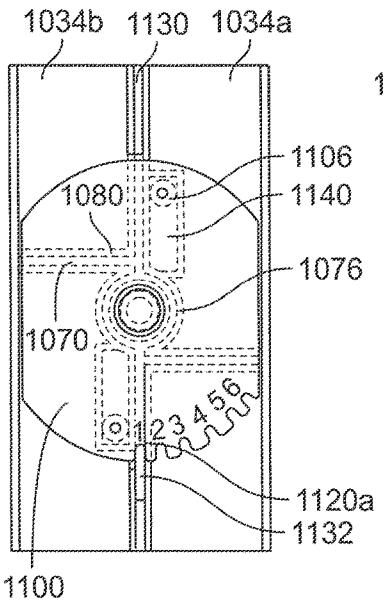
FIGS. 11*a*, 11*b*, and 11*c* each show a portion of the bottom of the product management display system wherein the side walls are in the non-extended position, partially-extended position, and fully extended position, respectively.

As shown in FIG. 1, the adjustable tray 1000 contains two adjustable dividers 1030*a* and 1030*b*. Adjustable dividers 1030*a* and 1030*b* may be identical and each can be formed as a single molded piece or alternatively of multiple components. FIG. 3 depicts a perspective inside view of an example adjustable divider 1030, which may be used as adjustable dividers 1030*a* and 1030*b*. Adjustable divider 1030 has a vertical wall 1032 and a horizontal panel 1034 extending perpendicular from the bottom of vertical wall 1032. In certain aspects, the wall 1032 is uniform and thin, for example ranging from 0.01 to 0.1 in. thick and in one particular example can be 0.05 in. thick. Optionally, panel 1034 has two channels 1080 formed on a top surface which can be configured to accept and move along the guides 1070 of the floor 1020. Openings 1084 and 1086, which can be half circular shaped, are formed along the inside edge of panel 1034. Two adjacent panels (1034*a* and 1034*b*) have corresponding openings that are half circular shaped that form a circular opening when the panels 1034 abut each other. The circular opening formed by the openings 1084 surround the corresponding buttons 1074 in floor 1020 and the buttons 1074 are configured to extend axially through the circular opening formed by the openings 1084 as seen in FIG. 1 and FIG. 6. Also the circular opening formed by the openings 1086 surround the corresponding receiver holes 1076 in floor 1020 as seen in FIG. 1 and FIG. 11A. As panels 1034*a* and 1034*b* move apart, corresponding adjacent openings separate from each other. In addition, the panels 1034*a*, 1034*b* may include various support ribs to provide additional support and rigidity to the adjustable tray 1000.

Figure 5:
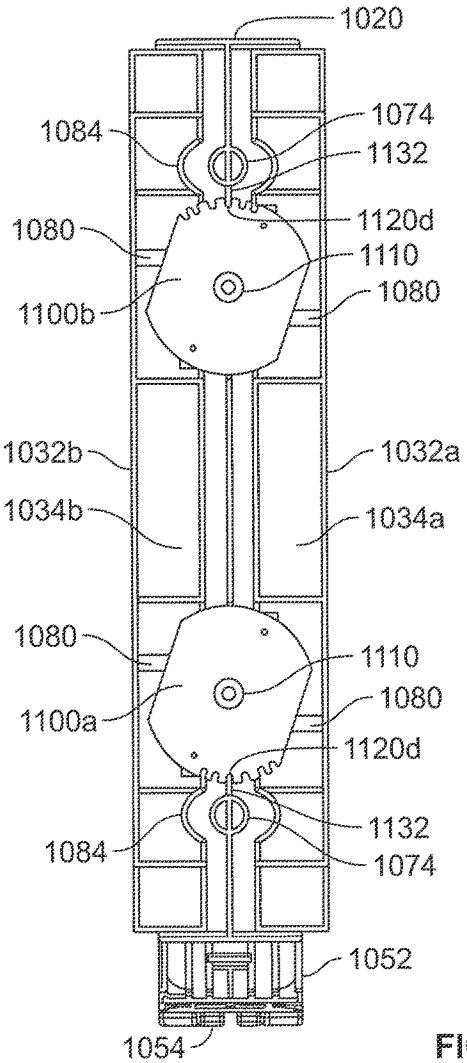
FIG. 5 shows a bottom view of the product management display system of FIG. 1.

FIG. 4 depicts a top view of the adjustable tray 1000 in a partially-extended position. FIG. 5 shows a bottom view of the adjustable tray 1000 in the partially-extended position shown in FIG. 4.

As shown in FIG. 4, floor 1020 is positioned over panels 1034*a* and 1034*b* of adjustable dividers 1030*a* and 1030*b*, respectively. Panels 1034*a* and 1034*b* are movable relative to floor 1020. As shown in FIG. 5, cams 1100*a*, 1100*b* are positioned underneath the panels 1034*a* and 1034*b* and are rotatably connected to floor 1020 with connectors 1110. In one aspect, the cams 1100*a*, 1100*b* can be secured to the floor by an interference fit or a snap-on type of connection between the connectors and the floor. In another aspect, the connectors may include screws or bolts 1112 for securing the cams 1100*a*, 1100*b* to the panels 1034*a* and 1034*b*.

Again referring to FIG. 5, to narrow the distance between walls 1032*a* and 1032*b*, the user causes rotation of the cams 1100 counterclockwise, and when it is desired to increase the distance between walls 1032*a* and 1032*b*, the user causes the cams 1100 to rotate clockwise.

The cams 1100*a*, 1100*b* may be utilized to lock in the desired width between the walls 1032*a*, 1032*b*. For example, as shown in FIG. 5, the rotation of the cams 1100*a*, 1100*b*, and hence movement of the walls 1032*a*, 1032*b*, can be prevented when the portion or finger 1132 formed on the support 1130 is placed in notch 1120*d*. Rotation of the cams 1100*a*, 1100*b*, and hence movement of the walls 1032*a*, 1032*b*, is allowed by actuating buttons 1074 to remove the portion 1132 of support 1130 from the notches 1120*d*. Specifically, to remove portion 1132 from the notch 1120*d*, the user presses button 1074 inwardly to also cause the portions 1132 to be moved out of alignment with cams 1100*a*, 1100*b*. The buttons 1074 can be formed as part of support 1130, and when depressed by a user, the portions 1132 of the support 1130 is pushed away from the notch until the portion 1132 moves away from the cams 1100*a*, 1100*b*. While maintaining the button 1074 in a depressed position, the walls may be pulled apart or pushed together as desired. When the desired spacing is achieved, the button 1074 is released allowing the portion 1132 of support 1030 to be positioned within a notch corresponding to the desired width of the particular product being dispensed. Additionally, the support and button are oriented such that the weight of the product maintains the portion 1132 in the notches to assist in maintaining the adjustable tray 1000 in the desired position and to prevent splaying of the dividers 1030. Walls 1032*a* and 1032*b* can be parallel to each other; hence both portions 1132 can be positioned within the notches in the same location on the cams, e.g. notch 1120*d* as shown, during use of the adjustable shelf. Otherwise, if the portions 1132 are placed in different notch locations on the cams, the walls 1032*a*, 1032*b* will be oriented non-parallel to or not in alignment with each other. Including a cam at the front and a cam at the rear of the adjustable tray 1000 prevents the dividers 1030*a*, 1030*b* from splaying relative to the floor 1020.

Figure 7:
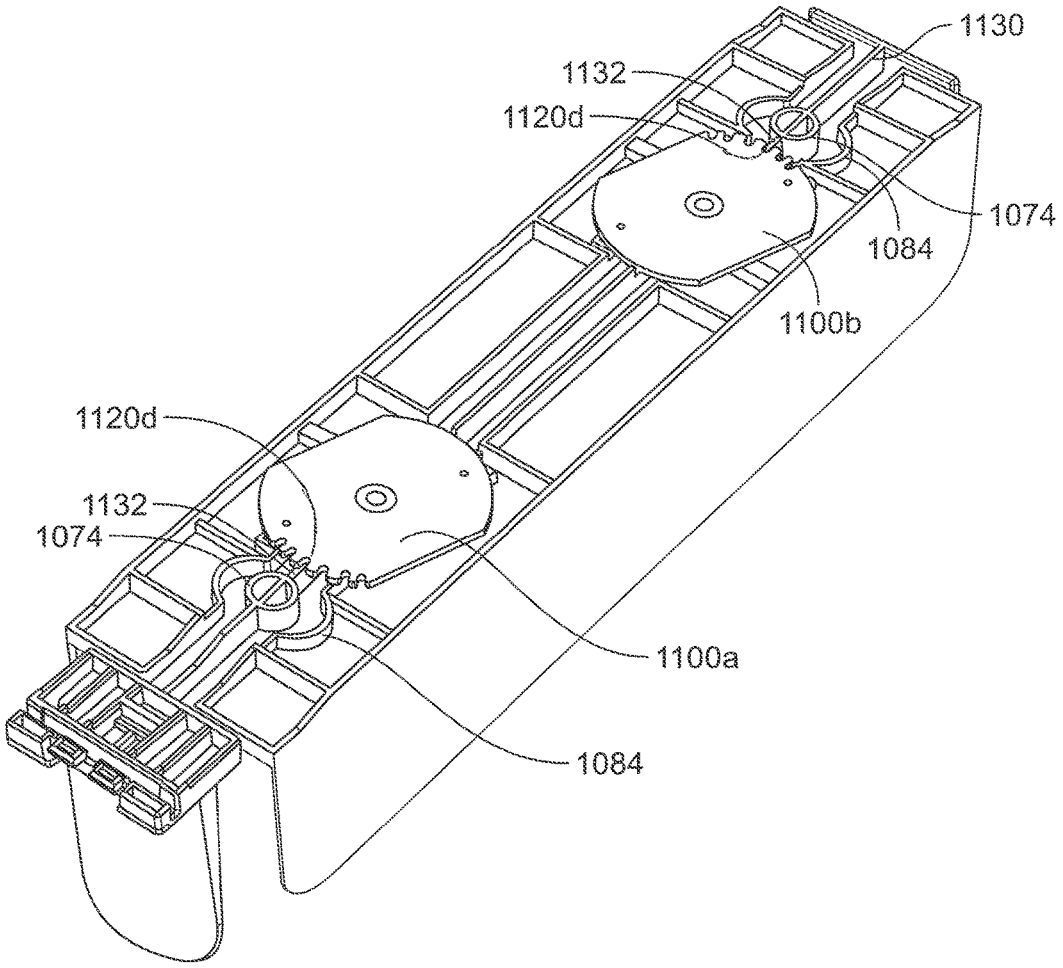
FIG. 7 shows a bottom perspective front view of the product management display system of FIG. 1 with the walls in a partially-extended position.
Figure 8:
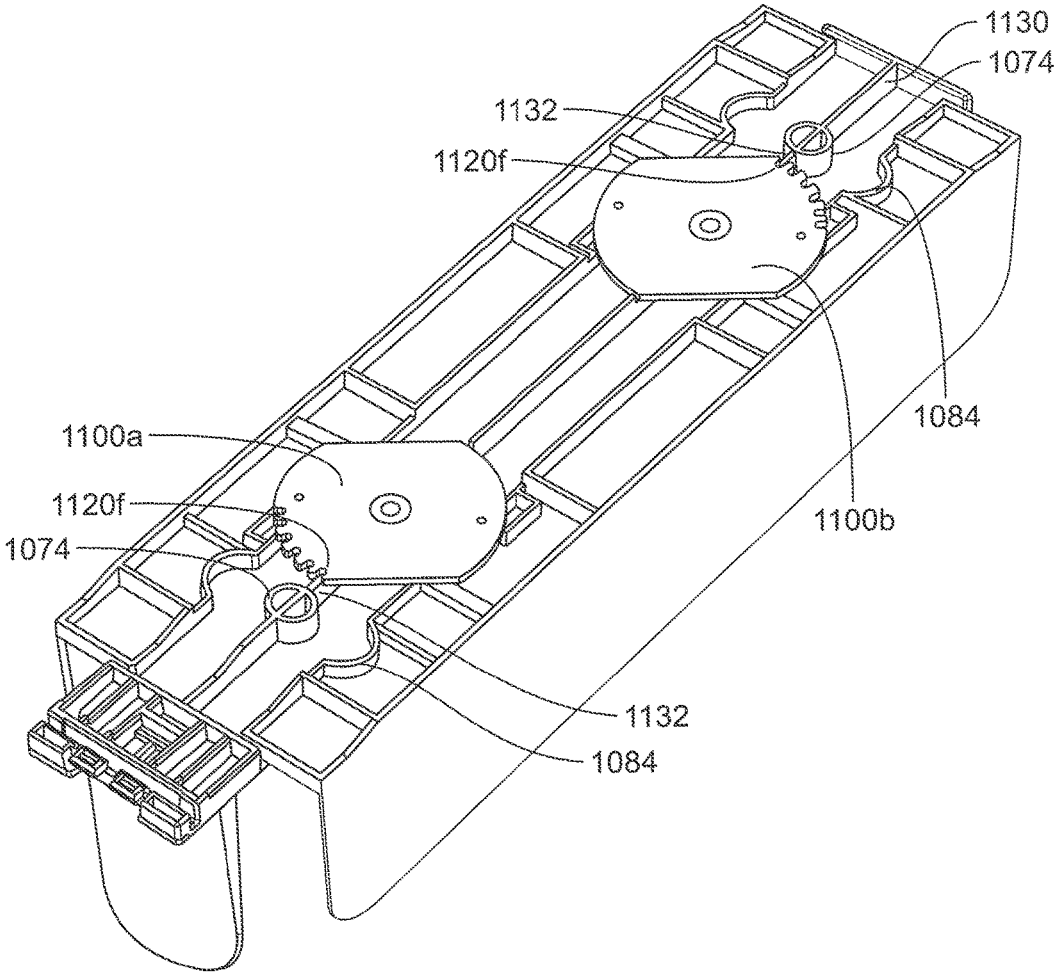
FIG. 8 shows a bottom perspective front view of the product management display system of FIG. 1 with the walls in a fully-extended position.

FIGS. 6, 7, and 8 depict the adjustable tray of FIG. 1 as an integral assembly in three configurations shown from the bottom. FIG. 6 depicts the width between walls 1032*a* and 1032*b* when the adjustable tray is at its narrowest configuration. Portions 1132 of support 1130 are positioned in notches 1120*a* of each cam 1100*a*, 1100*b*. FIG. 7 depicts the width between walls 1032*a* and 1032*b* when the adjustable tray is at a partially-extended configuration. Portions 1132 of support 1130 are positioned in notches 1120*d* of each cam 1100*a*, 1100*b*. FIG. 8 depicts the width between walls 1032*a* and 1032*b* when the adjustable tray is at its fully-extended configuration. Portions 1132 of support 1130 are positioned in notches 1120*f* of each cam 1100*a*, 1100*b*. As can be seen by FIGS. 6, 7, and 8, as the walls are adjusted, the cam is rotated. When the desired width between walls is reached, the cams are locked into place with portions 1132 of support 1130. Additionally, the notches 1120 and portions 1132 can be sized to provide a slight amount of spacing such that when the portions 1132 are engaged with the notches 1120, the dividers 1030*a*, 1030*b* can move slightly to accommodate for a slightly larger product.

Figure 9:
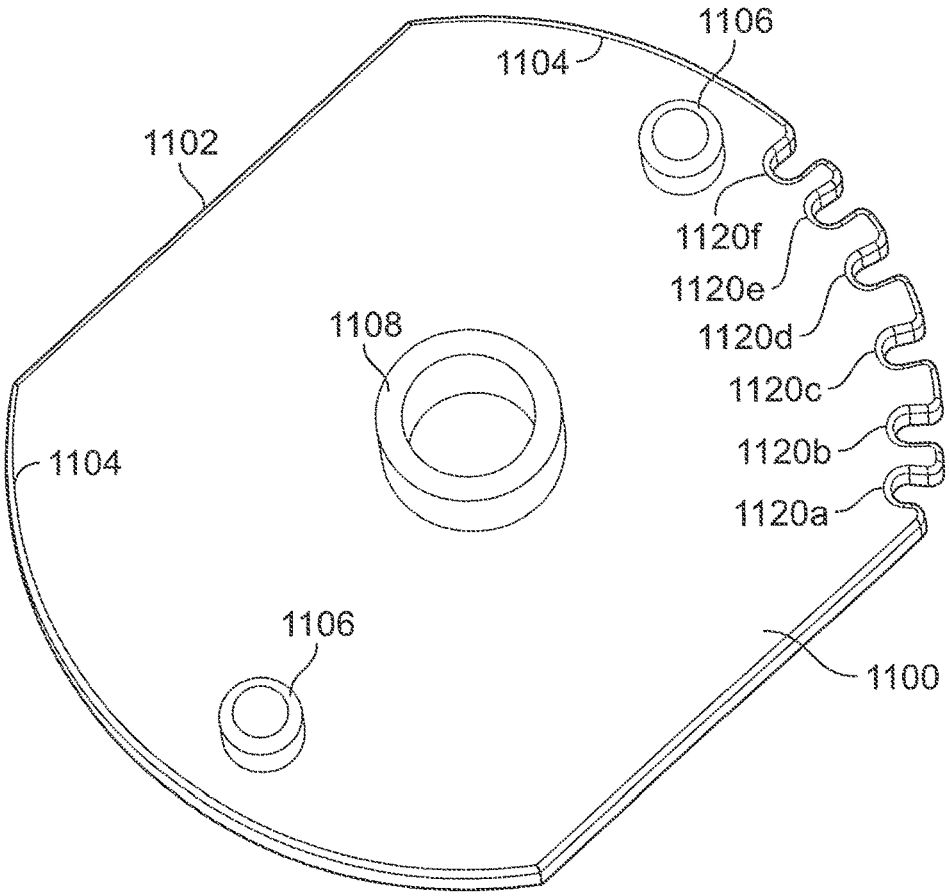
FIG. 9 shows a top perspective view of an adjustable cam used in the product management display system of FIG. 1.
Figure 10:
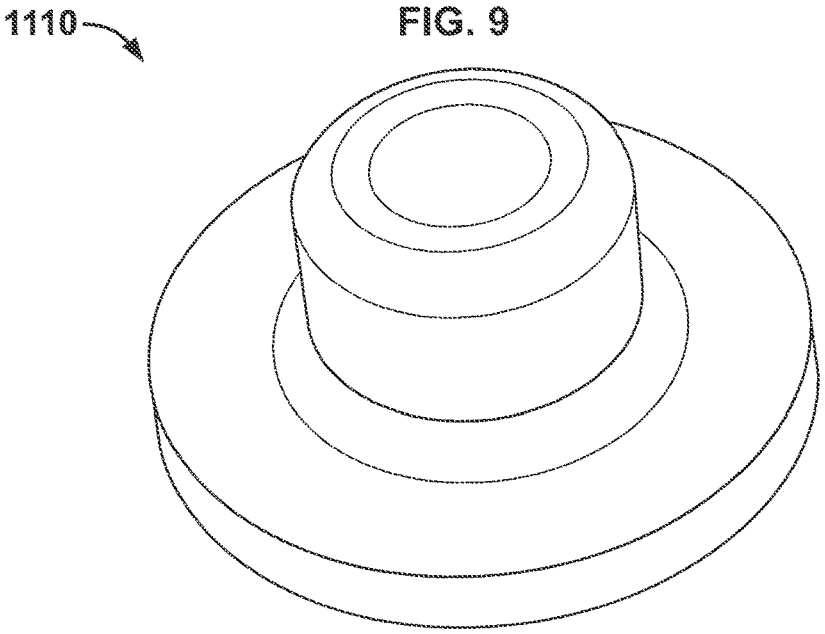
FIG. 10 shows a perspective view of a snap connector used to mount the adjustable cam onto the product management display system of FIG. 1.

Details and operation of the cams are shown in FIGS. 9, 10, and 11. FIG. 9 depicts upper facing side of cam 1100. The cam is essentially an oblong rectangle 1102 with two opposite curved side surfaces 1104 and sized to fit between the walls 1032*a* and 1032*b* when the width between the walls is narrowest as shown in FIG. 6. The center of the cam has a through hole with tubular walls 1108, formed integral with or separately from the cam, extending from the upper surface of the cam. The hole with tubular walls can receive a cam connector to connect the cam 1100 to the floor 1020. Two pegs 1106 for guiding the cam extend from the upper surface of the cams 1100. The pegs 1106 are positioned near the curved edge of the cam at opposite sides of the cam and function along with corresponding slots 1140 in the panels 1034*a* and 1034*b* to rotate the cam when the walls are widened or narrowed.

The cam has two or more notches 1120, for example, six notches, 1120*a-f*. There are six standard diameters for bottles and cans used in the beverage industry, for example. Six notches provide six cam positions and correspondingly six widths between the two walls. Therefore, in certain examples, the notches may not be at equal increments but instead correspond to the position needed to provide the proper width for each of the six standard diameters. These positions and sizes may also be printed on the adjustable tray for example on a bottom surface or on the cams. In one example, the positions and sizes can be hot-stamped onto the adjustable tray 1000.

| Notch | Bottle/Can |
|---|---|
| a | 8.3 ounce |
| b | 10/12 ounce |
| c | 16/20 ounce |
| d | 1 liter narrow |
| e | 1 liter wide |
| f | 32 ounce |

FIG. 10 depicts a cam connector which may be a snap connector or form an interference fit with the floor 1020 to connect the cam 1100 to the bottom of floor 1020. The cam connector 1110 is positioned in the hole with tubular walls of the cam from the lower side of the cam and connected to (snap or interference-fit) floor 1020 via receiver holes 1076. Other connection methods are also contemplated, for example, threaded, bayonet, ball and socket, etc.

Figure 11B:
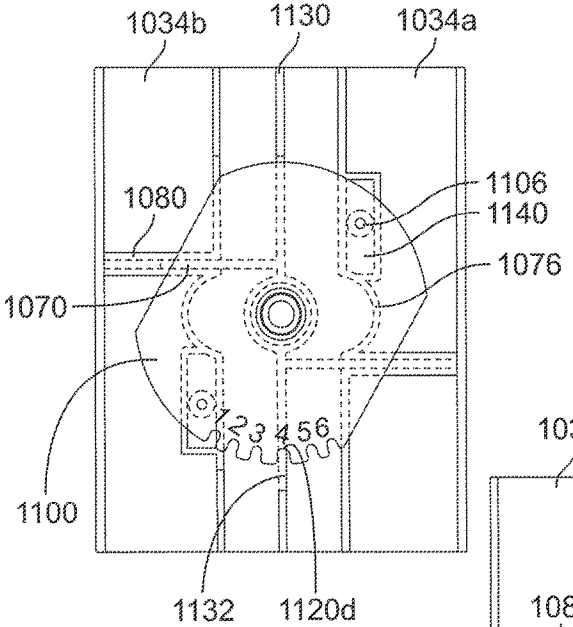
Figure 11C:
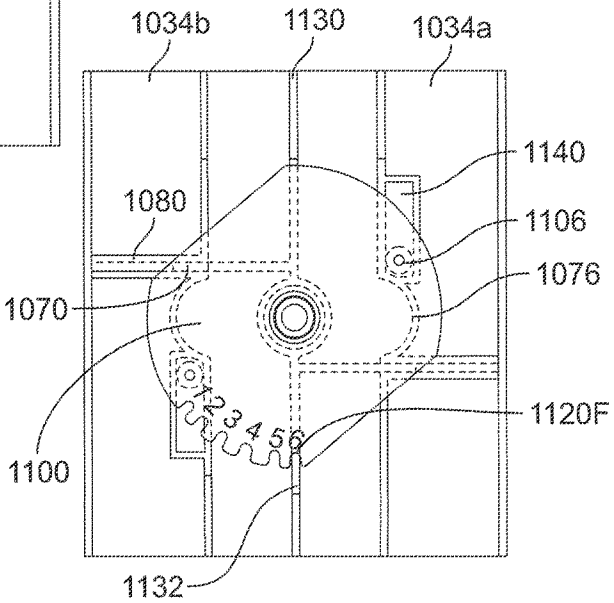

FIGS. 11A, 11B, and 11C depict details and operation of the cam, rotatably attached to the floor. As shown in FIGS. 11A-C, panels 1034*a* and 1034*b* each have a slot 1140 to accept the corresponding peg 1106 of cam 1100. The pegs 1106 are configured to move within their respective slots. Cams 1100*a* and 1100*b* are connected to, and remain pivoting centered on the floor 1020. The two pegs 1106 on each cam rotate symmetrically on either side of the floor 1020 pushing out the two dividers 1030*a* and 1030*b* equally at the same time. This spreads the dividers 1030*a* and 1030*b* apart evenly while keeping the center floor 1020 directly in the center of the lane. In this manner, the retainer 1050 of floor 1020, and possible pusher paddle, automatically remains directly in the center of the lane.

As an optional feature further shown, channels 1080 each receive a corresponding elongated guide 1070 of the floor 1120. The elongated guide 1070 moves along the channel 1080 as the width between the walls are adjusted. It is also contemplated that the channels and guides could be reversed such that the channels are placed on the floor, and the guides are placed on the dividers.

In FIG. 11*a*, the walls are in a closed or non-extended position. The portion 1132 of rail 1030 is in notch 1 (1120*a*). To widen the distance between walls 1032*a* and 1032*b*, the push button 1074 (see FIG. 5) is depressed to remove portion 1132 of rail 1030 from notch 1 (1120*a*). The user pulls apart walls 1032*a*, 1032*b* causing cam 1100 to rotate clockwise. The rotation is caused by the slot 1140 engaging the peg 1106 to cause the peg 1106 to travel along the slot 1140. The movement causes panels 1034*a* and 1034*b* to move relative to floor 1020. If present, the guides 1070 engage the channels 1080 and are configured to allow only lateral movement between the panels and the floor 1020. When the desired width is obtained, such as the width associated with notch 4 (1120*d*) as shown in FIG. 11B, the push button 1074 is released and portion 1132 of rail 1030 engages notch 4(1120*d*), locking the cam in place and preventing further movement of walls 1032*a* and 1032*b*.

To widen even further, push button 1074 (see FIG. 5) is depressed to remove portion 1132 of rail 1030 from notch 4 (1120*d*). The user pulls apart walls causing cam 1100 to rotate clockwise. When the desired width is obtained, such as the width associated with notch 6 (1120*f*) as shown in FIG. 11*c*, the push button 1074 is released and portion 1132 of rail 1030 enters notch 6 (1120*f*), locking the cam in place and preventing further movement of walls 1032*a* and 1032*b*.

To narrow the distance between the walls, push button 1074 (see FIG. 5) is depressed to remove portion 1132 of rail 1030 from notch 6 (1120*f*). The user pushes the walls causing cam 1100 to rotate counterclockwise. The rotation is caused by the slot 1140 engaging peg 1106 allowing it to travel along slot 1140. The movement causes panels 1034*a* and 1034*b* to move together relative to floor 1020. If present, the guides 1070 engage the channels 1080 to allow only lateral movement between the panels and the floor. When the desired width is obtained, such as the width associated with notch 4 (1120*d*) as shown in FIG. 11*b*, the push buttons 1074 are released and portions 1132 of the support 1030 enters notch 4, locking the cams 1100 in place and preventing further movement of walls 1032*a* and 1032*b*.

In this example, the adjustable tray contains two cams 1110, although the use of more or fewer cams is also contemplated. The support 1130 can include the requisite number of push buttons, in this case two, each adjacent to each cam 1100. A user may adjust one end of the adjustable tray by depressing one push button 1074, to remove the corresponding extended portion 1032 of support 1130 from the respective notch, pulling apart or pushing in the walls 1032*a* and 1032*b*, then releasing the push button 1074 to allow the extended portion of the support 1130 to be inserted into the notch corresponding to the width. The user then repeats the process at the other end of the adjustable tray. If the width is being changed from a small width to a large width, the process may need to be repeated several times. That is, if the width corresponding to notch one is adjusted to the width corresponding to width 6, one end is adjusted one or two notches, then the other end is adjusted by the same number of notches, then the entire procedure is repeated.

In this way, the adjustable tray can be adjusted to the appropriate size depending on the width of the product desired to be dispensed.

The cams may be positioned at any convenient place along the floor. The height of the walls and the height of the retainer may be any suitable height to maintain the product within the adjustable track. The adjustable walls may have slight flexibility or "give" to allow a product to fit that is marginally off standard sizes.

In one example, an adjustable tray for a merchandise display system can include one or more of: a retainer for limiting the movement of products loaded in the adjustable tray, a first wall extending from a first panel perpendicular to the first wall, and a second wall extending from a second panel perpendicular to the second wall. The spacing between the first wall and the second wall can be configured to be adjusted, and the first panel and the second panel can be configured to move to provide additional surface area for the adjustable tray when the space between the first wall and the second wall is increased.

In an example, the adjustable tray may also include a rack and pinion system for moving the dividers relative to one another, detent mechanisms, threaded rods, or ratcheting mechanisms.

Variations and modifications of the foregoing are within the scope of the present disclosure. For example, one of skill in the art will understand that multiples of the described components may be used in stores and in various configurations. The present disclosure is therefore not to be limited to a single system, nor the upright pusher configuration, depicted in the Figures, as the system is simply illustrative of the features, teachings and principles of the disclosure herein. It should further be understood that the concepts defined herein extends to all alternative combinations of two or more of the individual features mentioned or evident from the text and/or drawings. All of these different combinations constitute various alternative aspects of the present disclosure.

What is claimed is:

1. An adjustable tray for a merchandise display system comprising:

a floor having a floor surface for receiving products loaded in the adjustable tray and a support extending from the bottom of the floor;

a retainer for limiting movement of products loaded in the tray;

a first adjustable divider comprising a first wall and a second adjustable divider comprising a second wall for guiding the products along the floor surface; and at least one cam having multiple notches, wherein the cam is configured to prevent or allow movement of the first adjustable divider and the second adjustable divider, wherein a portion of the support is configured for placement in any one of the multiple notches of the cam to prevent rotation of the cam and prevent movement of the adjustable dividers;

wherein the first adjustable divider comprises a first panel extending perpendicularly from the bottom of the first wall toward the second wall and the second adjustable divider comprises a second panel extending perpendicularly from the bottom of second wall toward the first wall;

wherein the first adjustable divider and second adjustable divider are configured to move laterally with respect to the floor such that the spacing between the first vertical wall and the second vertical wall is adjusted to accommodate various dimensioned products.

2. The adjustable tray of claim 1 wherein the floor is positioned between the first wall and second wall above the first panel and second panel and the first panel and second panel being configured to move laterally under the floor panel; wherein the cam is rotatably attached to an underside surface of the floor; and wherein the first panel and second panel are movably positioned between the floor and the cam and are configured such that lateral movement of the adjustable dividers causes rotation of the cam.

3. The adjustable tray of claim 2 wherein the cam comprises tubular walls; wherein the first panel and the second panel have corresponding openings that surround the tubular walls, allowing the cam to rotate.

4. The adjustable tray of claim 1 wherein the floor further comprises a button positioned on a rail adjacent the cam, wherein pressing the button releases the portion from the notch, allowing the cam to rotate and allowing movement of the adjustable dividers.

5. The adjustable tray of claim 4 wherein the first panel and the second panel have corresponding spaces that together form an opening for the button, allowing the button to be pressed.

6. The adjustable tray of claim 1 wherein the cam has multiple notches such that each notch corresponds to a unique spacing between the first and second vertical walls; wherein the spacing is adapted to accommodate a predetermined product dimension.

7. The adjustable tray of claim 6 wherein at least some of the notches are not equidistant from adjacent notches.

8. The adjustable tray of claim 1 wherein the cam is an oblong rectangle with two opposite side surfaces and sized to fit between the first and second walls when the width between the first and second walls is at its narrowest.

9. The adjustable tray of claim 1 further comprising at least two cams.

10. The adjustable tray of claim 9 wherein each of the adjustable dividers and each of the cams are identical.

11. The adjustable tray of claim 1 wherein the floor further comprises guide rails extending vertically downward from the floor wherein the guide rails are positioned in corresponding channels in the panels to allow only lateral movement between the panels and the floor.

12. The adjustable tray of claim 1 wherein the floor and retainer comprises a single molded piece, or each adjustable divider comprises a single molded piece, or the floor and retainer comprises a single molded piece and each adjustable divider comprises a single molded piece.

13. A method of utilizing the adjustable tray of claim 1 comprising pulling apart or pushing together the first and second adjustable dividers causing the cam to rotate clockwise or counterclockwise.

14. The method of claim 13 further comprising initially pressing a button positioned on a rail adjacent each cam, wherein pressing the button releases the portion from a notch in the cam, allowing each cam to rotate.

15. An adjustable tray for a merchandise display system comprising:

a floor having a floor surface for receiving products loaded in the adjustable tray;

a retainer for limiting movement of products loaded in the tray;

a first adjustable divider comprising a first wall and a second adjustable divider comprising a second wall for guiding the products along the floor surface; and at least one cam having multiple notches, wherein the cam is configured to prevent or allow movement of the first adjustable divider and the second adjustable divider;

wherein the first adjustable divider comprises a first panel extending perpendicularly from the bottom of the first wall toward the second wall and the second adjustable divider comprises a second panel extending perpendicularly from the bottom of second wall toward the first wall;

wherein the first adjustable divider and second adjustable divider are configured to move laterally with respect to the floor such that the spacing between the first vertical wall and the second vertical wall is adjusted to accommodate various dimensioned products, wherein the cam is an oblong rectangle with two opposite side surfaces and sized to fit between the first and second walls when the width between the first and second walls is at its narrowest.

16. An adjustable tray for a merchandise display system comprising:

a floor having a floor surface for receiving products loaded in the adjustable tray;

a retainer for limiting movement of products loaded in the tray;

first adjustable divider comprising a first wall and a second adjustable divider comprising a second wall for guiding the products along the floor surface; and at least one cam having multiple notches, wherein the cam is configured to prevent or allow movement of the first adjustable divider and the second adjustable divider;

herein the first adjustable divider comprises a first panel extending perpendicularly from the bottom of the first wall toward the second wall and the second adjustable divider comprises a second panel extending perpendicularly from the bottom of second wall toward the first wall;

wherein the first adjustable divider and second adjustable divider are configured to move laterally with respect to the floor such that the spacing between the first vertical wall and the second vertical wall is adjusted to accommodate various dimensioned products, wherein the floor further comprises guide rails extending vertically downward from the floor wherein the guide rails are positioned in corresponding channels in the panels to allow only lateral movement between the panels and the floor.

* * * * *